US009973842B2

(12) United States Patent
Kim et al.

(10) Patent No.: US 9,973,842 B2
(45) Date of Patent: May 15, 2018

(54) PORTABLE SOUND EQUIPMENT

(71) Applicant: LG ELECTRONICS INC., Seoul (KR)

(72) Inventors: Donghan Kim, Seoul (KR); Ehwan Cho, Seoul (KR); Obyoung Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days. days.

(21) Appl. No.: 15/687,182

(22) Filed: Aug. 25, 2017

(65) Prior Publication Data

US 2018/0063620 A1 Mar. 1, 2018

(30) Foreign Application Priority Data

Aug. 26, 2016 (KR) ..... 10-2016-0109359

(51) Int. Cl.
*H04R 1/02* (2006.01)
*H04R 1/10* (2006.01)

(52) U.S. Cl.
CPC ..... *H04R 1/105* (2013.01); *H04R 1/1025* (2013.01); *H04R 1/1033* (2013.01); *H04R 1/1066* (2013.01); *H04R 1/1016* (2013.01); *H04R 2420/07* (2013.01)

(58) Field of Classification Search
CPC ..... H04R 2420/07; H04R 1/1016; H04R 1/1033; H04R 1/1041; H04R 1/1066; H04R 1/1091; H04R 1/105; H04R 1/10; H04R 1/1075; H04R 1/02; H04R 1/1025
See application file for complete search history.

(56) References Cited

U.S. PATENT DOCUMENTS

| | | | | |
|---|---|---|---|---|
| 4,695,106 | A | 9/1987 | Feldman et al. | |
| 2010/0166207 | A1* | 7/2010 | Masuyama | H04R 1/1041 381/74 |
| 2015/0172802 | A1* | 6/2015 | Takeno | H04R 5/0335 381/378 |
| 2015/0264474 | A1* | 9/2015 | Seo | H04R 1/1091 381/74 |
| 2016/0073200 | A1* | 3/2016 | Yoo | H04R 5/0335 381/311 |

(Continued)

FOREIGN PATENT DOCUMENTS

| | | | |
|---|---|---|---|
| JP | 2009-177803 | A | 8/2009 |
| JP | 2014-120203 | A | 6/2014 |

(Continued)

*Primary Examiner* — Thang Tran
(74) *Attorney, Agent, or Firm* — Birch, Stewart, Kolasch & Birch, LLP

(57) ABSTRACT

There is disclosed a portable sound equipment comprising a neckband wire configured to wrap a predetermined region of a user's neck; a main body coupled to one end of the neckband wire; a first printed circuit board disposed on an upper or lower surface of the main body; a flat bracket disposed on the first printed circuit board and having one surface which contacts with the first printed circuit board; a lateral bracket coupled to a lateral surface of the flat bracket; a second printed circuit board supported to the lateral bracket and toward a lateral surface of the main body; and a side button disposed on the second printed circuit board and exposed outside the lateral surface of the main body.

12 Claims, 17 Drawing Sheets

(56) References Cited

U.S. PATENT DOCUMENTS

| | | | | |
|---|---|---|---|---|
| 2016/0098138 | A1* | 4/2016 | Park | G06F 3/0416<br>345/173 |
| 2016/0366506 | A1* | 12/2016 | Kim | H04R 5/0335 |
| 2017/0347192 | A1* | 11/2017 | Seo | H04R 5/02 |

FOREIGN PATENT DOCUMENTS

| | | | |
|---|---|---|---|
| KR | 10-2011-0115720 | A | 10/2011 |
| KR | 10-2015-0110302 | A | 10/2015 |
| KR | 10-2015-0112436 | A | 10/2015 |
| WO | WO 2015/149247 | A1 | 10/2015 |

* cited by examiner

PORTABLE SOUND EQUIPMENT

Pursuant to 35 U.S.C. § 119(a), this application claims the benefit of earlier filing date and right of priority to Korean Application No. 10-2016-0109359, filed on Aug. 26, 2016, the contents of which are hereby incorporated by reference herein in their entirety.

BACKGROUND OF THE DISCLOSURE

Field of the Disclosure

Embodiments of the present disclosure relates to a portable sound equipment which may transceive an audio signal with a terminal by wireless communication and transmit a control signal for controlling the terminal based on a signal input via a user input unit.

Discussion of the Related Art

Sound equipment means a sound device for receiving a sound signal from a terminal and transmitting sound information collected through a microphone to the terminal. According to the related art, portable sound equipment has employed a wired mechanism for receiving a sound signal by inserting a terminal in an ear jack of a terminal. Yet, in aspects of mobility and use convenience, the demand for portable sound equipment's of wireless communication type is increasing recently.

Various types of portable sound equipment configured to be portable on user's body (e.g., a headphone type in shape of a band fit to a head, an ear-hung type, an ear-fit type, etc.) are being developed in consideration of portability.

Recently, there are increasing demands for a neckband type portable sound equipment which is wearable on a user's neck. Unless using the neck-band type portable sound equipment, the user is able to keep an earbud in the neck-band type portable sound equipment. The load of the neck-band type sound equipment is applied to the user's shoulder or collarbone, not the ears or head, so that the user can feel less heavy.

Accordingly, the neck-band type portable sound equipment is able to hold quite a weight to a preset degree and then enlarge the capacity of the battery to a specific level.

However, the neck-band type portable sound equipment still requires a small size and a light weight, only to have disadvantages of heat generation and durability.

Moreover, it is necessary to enhance the sense of wearing and a waterproof function as the wearable terminal which is worn on the user's body part.

SUMMARY OF THE DISCLOSURE

An object of the present disclosure is to solve the disadvantage of the heat generation caused in the conventional portable sound equipment and improve a waterproof function and durability.

To achieve these objects and other advantages and in accordance with the purpose of the disclosure, as embodied and broadly described herein, a portable sound equipment comprises a neckband wire configured to wrap a predetermined region of a user's neck; a main body coupled to one end of the neckband wire; a first printed circuit board disposed on an upper or lower surface of the main body; a flat bracket disposed on the first printed circuit board and having one surface which contacts with the first printed circuit board; a lateral bracket coupled to a lateral surface of the flat bracket; a second printed circuit board supported to the lateral bracket and toward a lateral surface of the main body; and a side button disposed on the second printed circuit board and exposed outside the lateral surface of the main body.

The portable sound equipment may further comprise a first sealing member configured to cover an inner surface of the side button and contact with the lateral surface of the main body by being compressed by the lateral bracket.

The portable sound equipment may further comprise a battery disposed on the other surface of the flat bracket, wherein the flat bracket spaces the battery a preset distance apart from the first printed circuit board.

An opening may be formed in a preset region of the flat bracket.

The portable sound equipment may further comprise a fastening screw hole formed in each of the flat bracket, the first printed circuit board and the surface of the main body where the first printed circuit board is disposed; and a first screw configured to fasten the flat bracket, the first printed circuit board and the main body to each other, after penetrating the fastening screw hole.

The portable sound equipment may further comprise a coupling unit provided in one end of the neckband wire and secured to an inside of the end of the main body; a waterproof rib projected along an inner circumference of the end of the main body; and a waterproof groove provided in the coupling unit and configured to be fastened to the waterproof rib.

The portable sound equipment may further comprise a coupling hole formed in the coupling unit; and a projection projected from one region of the main body, corresponding to the coupling hole, wherein the fastening structure between the waterproof rib and the waterproof groove is further inside toward the first printed circuit board than the coupling structure between the coupling hole and the projection.

The portable sound equipment may further comprise a first connection leading wire projected from one end of a waterproof region formed in the coupling unit and configured to be coupled to the first printed circuit board, wherein a non-waterproof region toward the neckband wire and a waterproof region toward the first printed circuit board are distinguished from each other with respect to a boundary of the coupling region between the waterproof rib and the waterproof groove.

The portable sound equipment may further comprise a first connection wire coupled to the first printed circuit board after penetrating the neckband wire; a wire tube in which the first connection leading wire is mounted; and a coupling unit coupled to one end of the wire tube and fixed in one end of the main body, wherein the neckband wire comprises a first wire portion covering and coupled to the wire tube and a region of the coupling unit; and a second wire portion coupled to a region which contacts with the user's neck.

The coupling unit may be double-injection-molded in the wire tube and one region of the coupling, and the second wire portion may be double-injection-molded in the first wire portion.

The first wire portion may comprises TPU (thermoplastic Poly Urethane); and a pattern engraved or embossed on one region of the second wire.

The portable sound equipment may further comprise an I/O port provided in the main body; a waterproof cap configured to selectively expose the I/O port to an outer surface of the main body; a second sealing member coupled to an inner surface of the waterproof cap; and a waterproof band provided along an outer surface of the second sealing member.

The effects of the wireless sound equipment according to the embodiments of the disclosure will be as follows.

According to at least one of the embodiments, the portable sound equipment is capable of minimizing the disadvantage of the heat generation caused by the heat of the electronic components.

Furthermore, the portable sound equipment is capable of reducing the production time and cost.

Still further, the portable sound equipment is capable of enhancing the waterproof function of some or entire region.

Still further, the portable sound equipment is capable of securing the neckband wire and the main body stably to prevent the neckband wire and the main body from spinning with no traction.

Still further, the portable sound equipment is capable of enhancing the design beauty.

Last, the portable sound equipment is capable of enhancing the user's wear sensation of the portable sound equipment.

It is to be understood that both the foregoing general description and the following detailed description are exemplary and explanatory and are intended to provide further explanation of the disclosed subject matter as claimed.

BRIEF DESCRIPTION OF THE DRAWINGS

The present invention will become more fully understood from the detailed description given herein below and the accompanying drawings, which are given by illustration only, and thus are not limitative of the present invention, and wherein.

DESCRIPTION OF SPECIFIC EMBODIMENTS

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Figure 1:
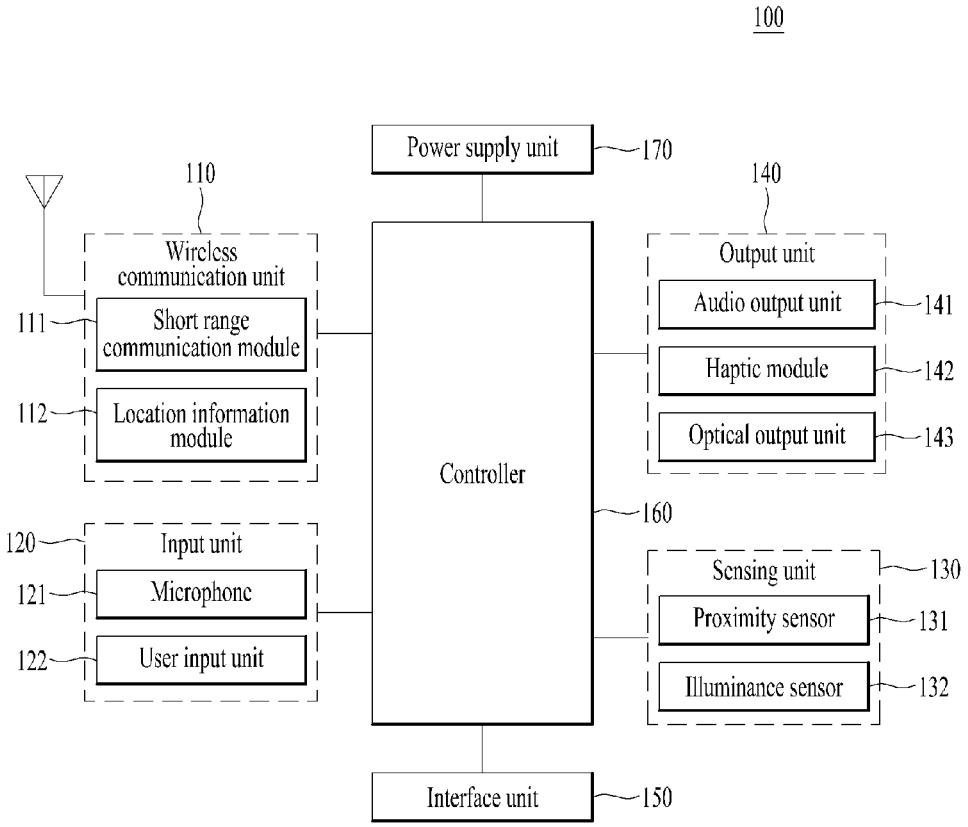
FIG. 1 is a block diagram illustrating a structure of a portable sound equipment according to one embodiment of the present disclosure.

FIG. 1 is a block diagram of a wireless sound equipment according to one embodiment of the disclosure.

The wireless sound equipment 100 includes a wireless communication unit 110, an input unit 120, a sensing unit 130, an output unit 140, an interface unit 150, a controller 160 and a power supply unit 170.

The elements shown in FIG. 1 are not necessary to realize the portable sound equipment. The portable sound equipment described in the specification may include more or less ones of the elements described above.

More specifically, the wireless communication unit 110 of the elements may include one or more modules which facilitates wireless communication between the portable sound equipment 100 and a wireless communication system, another mobile terminal or an external server. Also, the wireless communication unit 110 may include one or more modules for connecting the portable sound equipment 100 with one or more networks.

Such the wireless communication unit 110 may include at least one of a short range communication module 111 and a location information module 112. If necessary, it may further include a mobile communication module or a wireless internal module.

The short range communication module 111 is configured to facilitate short range communication and support the short range communication by using at least one of Bluetooth™, RFID (Radio Frequency Identification), IrDA (Infrared Data Association), UWB (Ultra Wideband), ZigBee, NFC (Near Field Communication), Wi-Fi (Wireless-Fidelity), Wi-Fi Direct and Wireless USB (Wireless Universal Serial Bus) techniques.

The short range communication module 111 may support wireless communication between the portable sound equipment 100 and a wireless communication system, another mobile terminal or a network in which another mobile terminal (or an external server) is located. The short range communication networks may be wireless personal area networks.

The short range communication module 111 may be configured to sense or recognize a communicable terminal which is located near the portable sound equipment 100. In case the sensed terminal is the one authenticated to communicate with the portable sound equipment 100, the controller 160 may receive some of the data processed in the mobile terminal through the short range communication module 111. Accordingly, the user of the portable sound equipment 100 is able to use the data processed in the terminal through the wearable device.

For example, when there is a call received in the terminal, the user is able to answer a call or tall by using the portable sound equipment 100.

The location information module 112 is the module for acquiring the location or present location of the portable sound equipment 100. Typical examples of the location information module 112 include GPS (Global Positioning System) and WiFi (Wireless Fidelity). As one example, the mobile terminal using a GPS module is capable of acquiring the location of the portable sound equipment 100 based on a signal transmitted from a GPS satellite. As another example, the portable sound equipment 100 using WiFi is capable of acquiring the location of the portable sound equipment 100 based on information of AP (Wireless Access Point) configured to transceive a wireless signal with the Wi-Fi module. If necessary, the location information module 112 may additionally perform a function of another module provided in the wireless communication unit 110 to gain data about the location of the portable sound equipment 100. The location information module 115 is the module used in acquiring the location or present location of the portable sound equipment 100, not limited to the module for directly calculating or acquiring the location of the portable sound equipment 100.

The input unit 120 may include a microphone (MIC) 121 an audio input unit for inputting an audio signal and a user input unit 122 for receiving input information from the user (for example, a touch key, a mechanical key and the like). The voice or image data collected in the input unit 120 is analyzed and processed into the user's control command.

The user input unit 122 is configured for the user to control the portable sound equipment 100. Examples of the user input unit 122 include a call button, a button for adjusting a volume, a power button and a storage button for storing an audio cable in a main body.

The user input unit 122 may include only the call button and the pair of the volume adjustment buttons or further include a play/stop button and a playlist change button rather than them.

The size of the portable sound equipment 100 is restricted and users are likely to perform inputs, not looking at the user input unit 122. If too many buttons are provided, it becomes difficult to distinguish each function of the buttons from each other. Accordingly, the time and frequency of button pressings and imputable control commands may be expanded by using the limited number of the buttons and the combination of the buttons.

The microphone 121 processes an audio signal input from an external device into electric voice data. The processed voice data may be used based on the function performed in the portable sound equipment 100 (or the application program implemented in the portable sound equipment) or transmitted to the external terminal or server via the wireless communication unit 110. Various noise removal algorithms can be realized in the microphone to remove the noise generated while external audio signal is input.

The sensing unit 130 may include one or more sensors for sensing at least one of user information and peripheral information near the portable sound equipment. Examples of the sensing unit 130 may include one or more of a proximity sensor 131, an illumination sensor 132, a touch sensor, an acceleration sensor, a magnetic sensor, a G-sensor, a gyroscope sensor, a motion sensor, a RGB sensor, an IR sensor (Infrared sensor), a finger scan sensor, a ultrasonic sensor, an optical sensor, a microphone 121, a battery gauge, an environment sensor (e.g., a barometer, a hygroscope, a thermometer, a radiation detection sensor, a thermal sensor, a gas sensor and the like) and a chemical sensor (e.g., an electronic nose, a health care sensor, a biometric sensor and the like). Meanwhile, the portable sound equipment in accordance with the present disclosure may use combination of the information data sensed by at least two sensors.

Especially, the sensor unit 130 may include a sensor for sensing presence of an earphone at a holder and the magnetic sensor may be used as a typical example of such a sensor.

The output unit 140 is configured to generate outputs which are related with sight, heating and touch. The output unit 140 may include at least one of an audio output unit 141, a haptic module 142 and an optical output unit 143.

The audio output unit 141 is a device configured to output sounds based on an audio signal. Examples of the audio output unit 141 include an earphone configured to be inserted in the user's ears and transmit sounds and a speaker configured to output sounds while the user is not wearing the earphone.

The interface unit 150 functions as a passage to diverse types of external devices which are connected with the portable sound equipment 100. Such the interface unit 150 may include at least one of an external charger port and a wired/wireless data port. The portable equipment 100 may perform a proper control which is related with the connected external device(s), corresponding to the external device(s) connected with the interface unit 150.

The controller 160 is implemented to control overall operations of the portable sound equipment 100 as well as operations which are related with the application programs. The controller 160 may process signal, data information the input or output via the elements mentioned above.

The power supply unit 170 is configured to supply the external electric power and internal power applied thereto to each of the elements provided in the portable equipment 100. Such the power supply unit 170 includes a battery and the battery may be an internal battery or exchangeable battery.

A predetermined number of the elements may be cooperative to realize control and execution or a control method of the portable sound equipment in accordance with diverse embodiments which will be described hereinafter.

Figure 2:
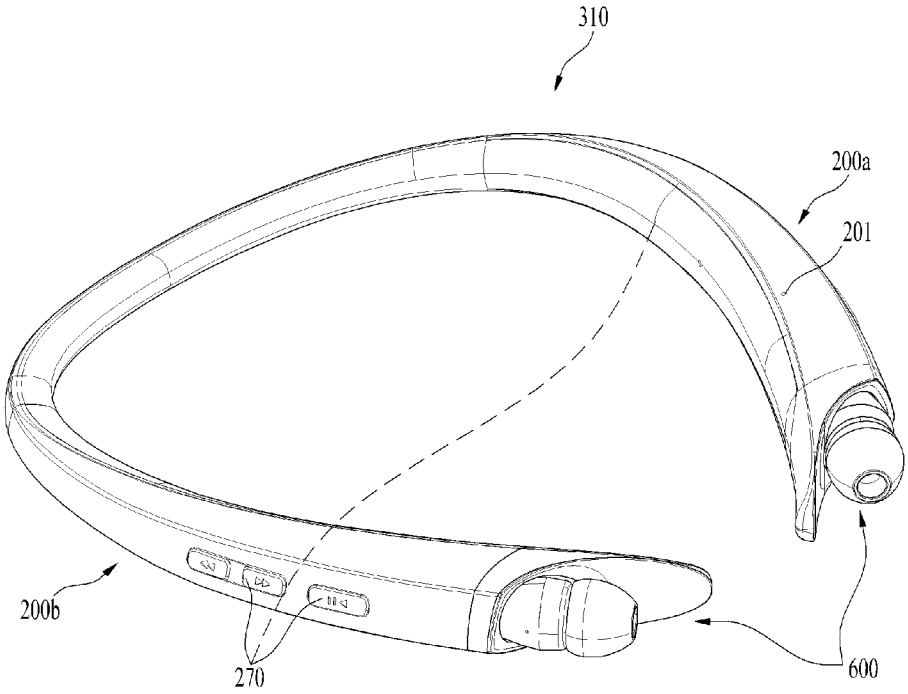
FIG. 2 is a perspective diagram illustrating the portable sound equipment.
Figure 3:
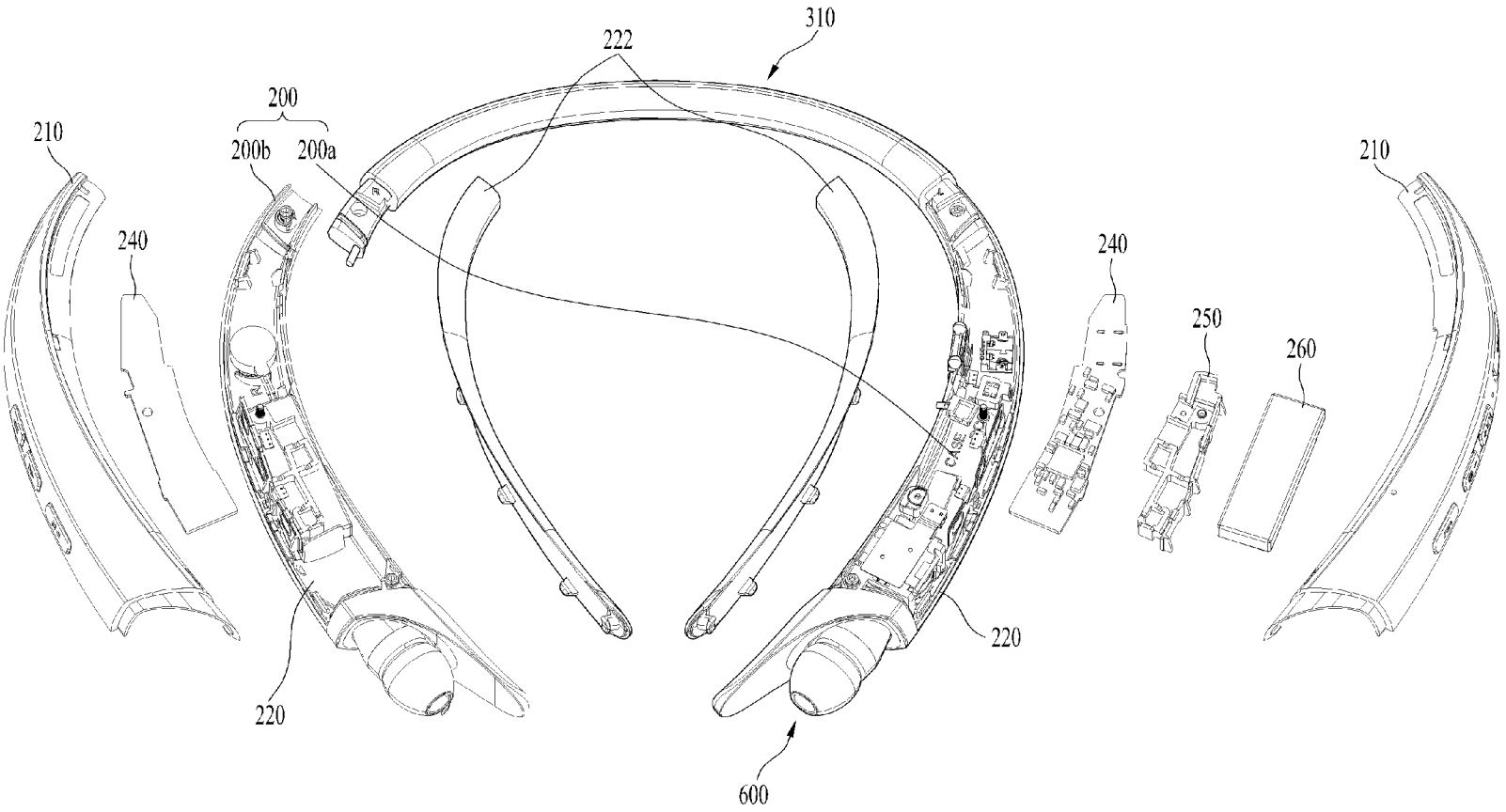
FIG. 3 is an exploded perspective diagram illustrating the portable sound equipment.

FIG. 2 is a perspective diagram illustrating the portable sound equipment 100 and FIG. 3 is an exploded perspective diagram illustrating the portable sound equipment 100.

The portable sound equipment 100 may simply include a neck-band wire 310 and a main body 200. The neckband wire 310 is configured to wrap around a predetermined area of the user's neck to dispose the portable sound equipment 100 on the user's neck.

The main body 200 and the neckband wire 310 are coupled to each other to form a 'U'-shaped design. If necessary, both ends are detached to selectively form an '0'-shaped design.

The main body 200 may be coupled to both ends of the neckband wire. The main body 200 may be divided into a first body coupled to one end of the neckband wire 310 and a second body coupled to the other end of the neckband wire 310.

Some of the technical features which will be described later in relation with the main body 200 may be applied to both of the first and second bodies identically. To prevent repetition of descriptions, only one of the first and second bodies composing the main body 200 will be described.

The main body 200 may be integrally formed as one body or formed of an upper case 210 and a lower case 220 which are able to be coupled to each other to load internal components in the main body 200. One of the upper and lower cases 210 220 may include even a lateral surface of the main body 200. Alternatively, a lateral case may be provided as an auxiliary member to be coupled to the upper and lower cases 210 and 220. In the present disclosure, it is premised that the upper case 210 defines a lateral region of the main body 200.

The portable sound equipment 100 is likely to be exposed to moisture or sweat so that it can further include a waterproof function. A rib may be provided to cover a gap between the upper case 210 and the lower case 220 or a waterproof member is disposed there between, so as to prevent water from permeating between the upper case 210 and the case 220.

The main body 200 is fabricated by injection-molding of polymer. For example, the main body 200 is made of a plastic material with a higher strength such as PS (Polystyrene). The main body 200 may be made of a heterogeneous material which partially includes metal, glass, leather or the like.

Polyurethane may be coated on a surface of the main body 200 to protect the internal components and facilitate the close contact of the main body with the user's body part at the same time. The polyurethane coating on the surface of the main body 200 may allow the user to feel the sense of unity about the external design of the portable sound equipment and also the main body 200 to be disposed on the user's skin in close contact, without shaking when the user is moving. Accordingly, the user is able to have a good wear-sensation, when wearing the portable sound equipment 100.

In the main body 200 may be loaded most of the internal components which are capable of performing the functions of the portable sound equipment 100. For example, diverse components such as the main printed circuit board, the wireless communication unit, the battery 260 and a collect module mentioned above may be loaded in the main body 200.

The wireless communication unit, the microphone 201 and the like may be loaded in the main printed circuit board. Also, the main board is connected with the battery 260, the user input unit, the audio output unit and the like. The components loaded in the main body 200 may be provided in both opposite sides of the main body, in other words, the first body and the second body, in symmetry, or only in one side.

The neckband wire 310 has elasticity and it is capable of being deformed elastically when an external force is applied and being restored elastically to restitute when the applied force is removed.

Figure 4:
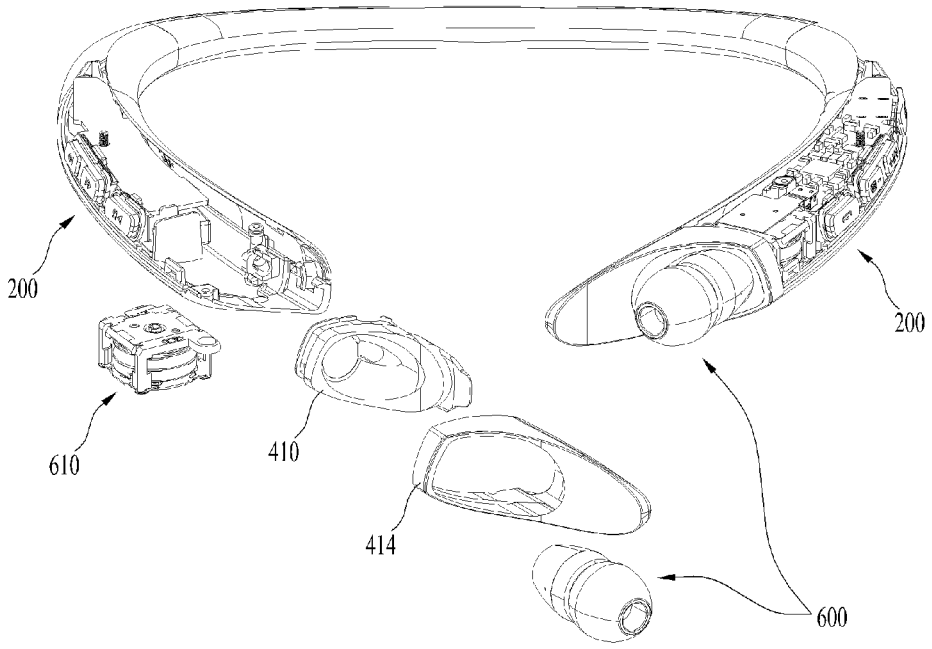
FIG. 4 is a diagram partially illustrating the portable sound equipment.

FIG. 4 is a diagram partially illustrating the portable sound equipment 100.

The earbud is insertedly worn on the user's ear to transmit sounds and connected with the printed circuit board via the audio cable. The main printed circuit board controls the earbud to control sounds output based on an audio signal.

The main body 200 in accordance with the present disclosure may include holders 410 which are provided in both sides to dispose earbuds therein, respectively. The holder 410 may be formed in an end of the lower case 220 not to be exposed outside when the user is wearing the portable sound equipment 100.

The holder 410 includes a recess which is concavely formed, corresponding to the earbud, and a cable hole for allowing the audio cable to penetrate to connect the earbud with the main printed circuit board.

While the audio cable is wound around the collect module by the elasticity of a rotary member mounted in the main body 200, the earbud is automatically secured to the holder 410.

An extended bracket is configured to be coupled to a rim of the holder 410 and extend the entire length of the main body 200 provided in the portable sound equipment 100. In addition, there are material constraints for fixing the holder 410 to the main body 200, only to cause a bad feeling in direct contacting with the user's body part or fail to have a sufficient friction.

The extended bracket is provided as a heterogeneous material which is different from the holder 410 and configured to provide a sufficient frictional force, with directly contacting with the user's body part.

Figure 5:
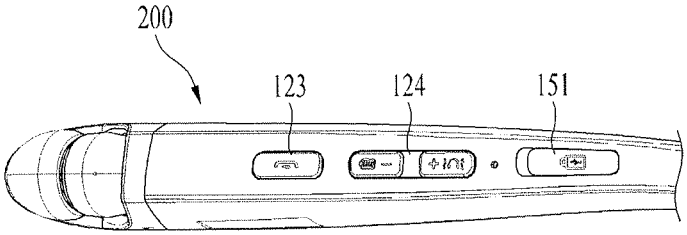
FIG. 5 (*a*) illustrates an outer surface of a first body and FIG. 5 (*b*) illustrates an outer surface of a second body and FIG. 5 (*c*) illustrates an inner surface of the first body.
Figure 5:
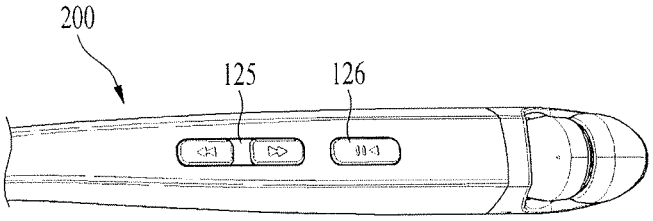
Figure 5:
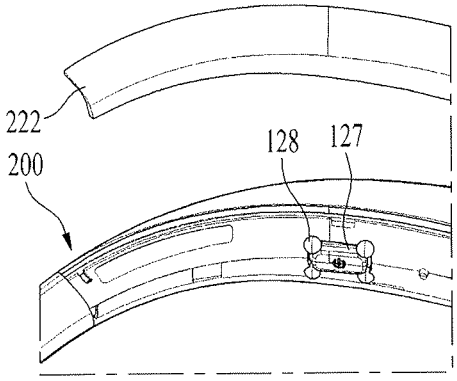

FIG. 5 (*a*) illustrates an outer surface of a first body and FIG. 5 (*b*) illustrates an outer surface of a second body and FIG. 5 (*c*) illustrates an inner surface of the first body.

The main body 200 may include an input/output port 151 (I/O port) as a user input unit for receiving inputs from a user interface and an interface unit for exchanging an electrical signal with an external device.

The main body 200 may include a call receive button 123, a volume control button 124, a play select button 125 and a play/stop button 126 as user input unit.

Moreover, a power button 127 may be provided in an inner surface of the main body 200. The power button is designed not to be relatively pressed easily so as to prevent the unintended on or off of the power.

An elastic ball 128 may be provided adjacent to the power button 127 and a cover case 222 may be further provided to cover the power button 127 and the elastic ball 128.

The cover case 222 may be configured to cover at least predetermined region of the upper or lower case 210 or 220.

A dome key 271, which is physically pressable, may be used as the button.

As another example, a toggle button or switch which receives inputs by sliding may be provided as the button, different from the press button.

All or some of the buttons provided in the user input unit may belong to a side button 270 which will be described later. Types of the user input units may be expanded to an area for functioning a similar range to the concept described above, not limited only to the functions mentioned above.

Figure 6:
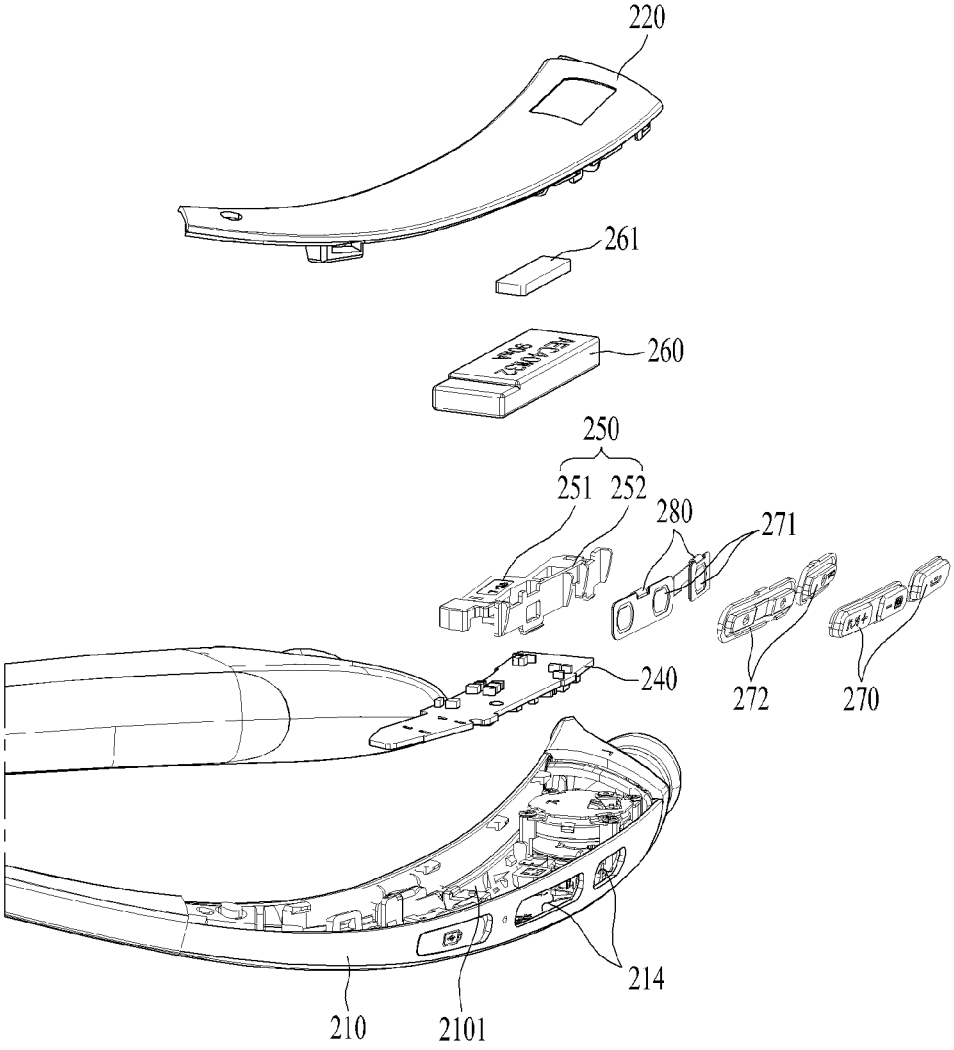
FIG. 6 is an exploded perspective diagram partially illustrating the portable sound equipment and FIG. 7 is a perspective diagram partially illustrating the coupling of the portable sound equipment.
Figure 7:
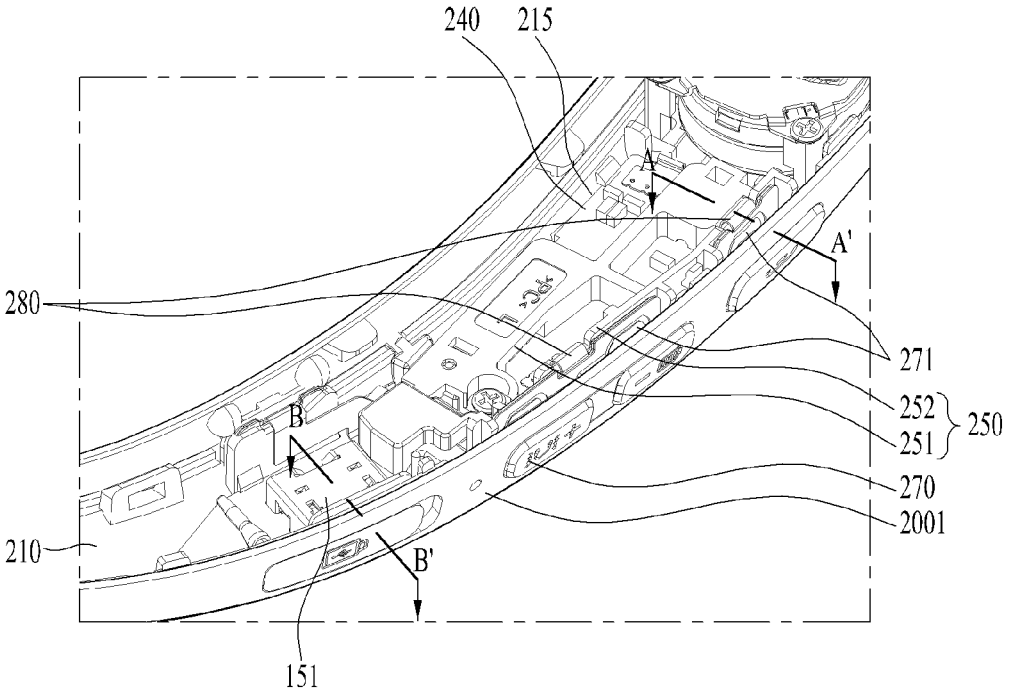

FIG. 6 is an exploded perspective diagram partially illustrating the portable sound equipment 100 and FIG. 7 is a perspective diagram partially illustrating the coupling of the portable sound equipment 100.

All or some of the electronic components used in the portable sound equipment 100 may be loaded on a first printed circuit board 240.

As most of the electronic components are loaded, the first printed circuit board 240 requires a relative broad space in the main body 200. It may be formed in a single plate and the components may be loaded in a front or rear surface of the plate shaped printed circuit board.

The main body 200 may be may be formed in a flat bar with a rectangular or square-like cross section area in a longitudinal direction.

The flat surface of the bar-shaped main body 200 may define a top or bottom surface of the main body 200. As mentioned above, the first printed circuit board 240 requires a large area. The first printed circuit board 240 provided in parallel with the top or bottom surface of the main body 200 is capable of using the space more effectively than the one provided perpendicular to the top or bottom surface.

The first printed circuit board 240 may be disposed on an upper surface of the main body 200, in other words, an upper surface 2101 of the upper case. A guide region 215 having a boundary corresponding to some of an outer region of the first printed circuit board 240 to seat the first printed circuit board 240 stably.

The flat bracket 251 may be disposed on the first printed circuit board 240 disposed in the main body 200, to contact with one surface of the first printed circuit board 240, The power supply unit may include the battery 260 for supplying the power to the portable sound equipment 100. The battery 260 may have a flat cube shape to maximize the spatial efficiency.

The flat bracket 251 distinguishes the battery 260 from the first printed circuit board 240. One surface of the battery 260 may be disposed in the flat bracket 251 and the other surface in the lower case 220. A damping sheet 261 configured to dampen the impact applied to the battery 260 may be provided between the battery 260 and the lower case 220.

The flat bracket 251 may include thermos-plastic such as polycarbonate.

A lateral bracket 252 may be coupled to a lateral surface of the flat bracket 251. The lateral bracket 252 and the flat bracket 251 may be provided as fixing brackets 250 formed of the same material as one body. The flat bracket 251 and the lateral bracket 252 integrally formed with each other may reduce the production time and increase the strength more than those coupled to each other as independent members.

One surface 2511 of the lateral bracket 252 may be located toward a lateral surface of the main body 200. Especially, one surface of the lateral bracket 252 may be in parallel with an inner lateral surface of the main body 200.

A side button 270 may be provided in an outer lateral surface of the main body 200.

The side button 270 may be exposed via a hole 214 formed in the upper or lower case 210 or 220 to be pressed by the user.

As mentioned above, the side button 270 may be provided as a dome key 271 configured to recognize a signal when it is pressed physically.

The second printed circuit board 280 may be supported to the lateral bracket 252 and located toward the lateral surface of the main body 200. When pressed from the outer surface of the main body 200, the side button 270 may generate and transmit an input signal to the second printed circuit board via the dome key 271.

The second printed circuit board 280 may be electrically connected with the first printed circuit board 240 along a corner of the lateral bracket 252.

The dome key 271 and the second printed circuit board 280 may be provided as one module as occasion demands.

The lateral bracket 252 may be employed to support the side button 270, a first sealing member 272, the dome key 271 and the second printed circuit board 280.

The lateral bracket 252 may be used in stably holding the side button 270, even if the side button 270 is pushed and compressed inwardly by a preset distance.

Figure 8:
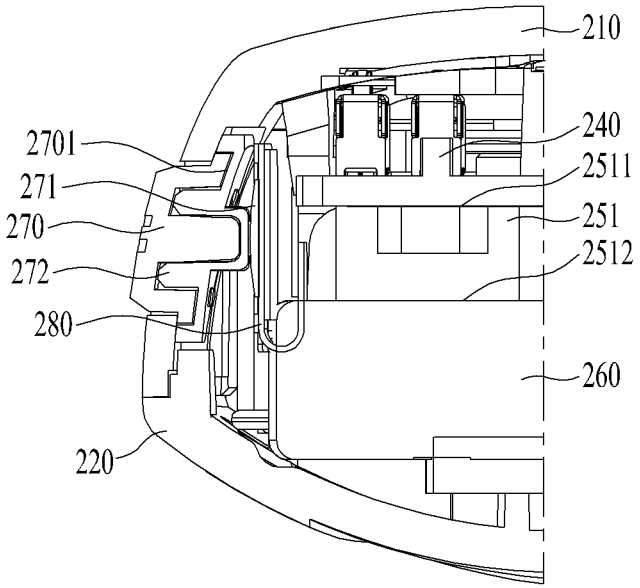
FIG. 8 is a sectional diagram of FIG. 7 along A-A'.

FIG. 8 is a sectional diagram of FIG. 7 along A'A.

The first sealing member 272 is provided between the side button 270 and the lateral bracket 252 and configured to realize the waterproof structure between the side button 270 and the main body 200. The first sealing member 272 may cover an inner surface region of the side button 270.

Especially, the first sealing member 272 may cover an inner surface of the side button 270 and even a boundary between the inner surface and the main body 200. The lateral bracket 252 is employed to push the inner surface of the first sealing member 272 to prevent the gap through which liquid might flow between the first sealing member 272 and the main body 200.

The first sealing member 272 may include an elastic material with a restoring force. The side button 270 is able to be restored by the restoring force of the first sealing member 272 and the restoring force of the dome key 271.

A predetermined region of the first sealing member 272 may be configured to selectively contact with the dome key 271 provided in the second printed circuit board 280.

A corresponding region of the lateral bracket to the boundary with the first sealing member 272 may be employed to push the first sealing member 272.

The battery 260 may be disposed on the other surface 2512 of the flat bracket. The flat bracket 251 may be configured to space the battery 260 a preset distance from the first printed circuit board 240.

When using the portable sound equipment 100, heat might be intensively generated in the battery 260 and the first printed circuit board 240 and it is preferred to space the battery 260 a preset distance apart from the first printed circuit board 240.

Figure 9:
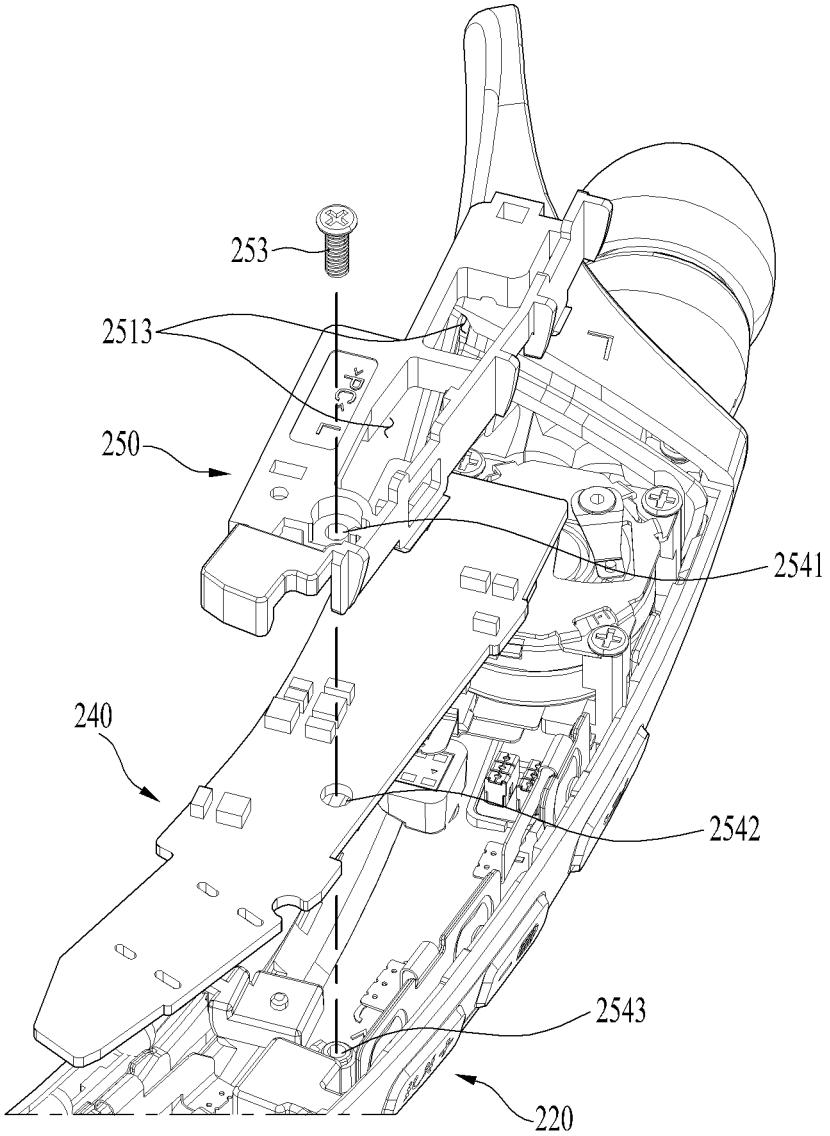
FIG. 9 is an exploded perspective diagram partially illustrating the portable sound equipment.

FIG. 9 is an exploded perspective diagram partially illustrating the portable sound equipment 100.

An opening 2513 may be formed in one region of the flat bracket 251 to lessen the overall weight and perform a heat radiation function effectively.

A fastening screw hole 254 may be provided to have a first screw 253 pass there through. The fastening screw hole 254 includes a first screw hole 25341 formed in the flat bracket 251; a second screw hole 2542 formed in the first printed circuit board 240; and a third screw hole 2543 formed in the main body 200.

The first screw 253 may be configured to prevent the movement of the first printed circuit board 240 in the main body 200 and simplify the production process so as to reduce the production cost.

Figure 10:
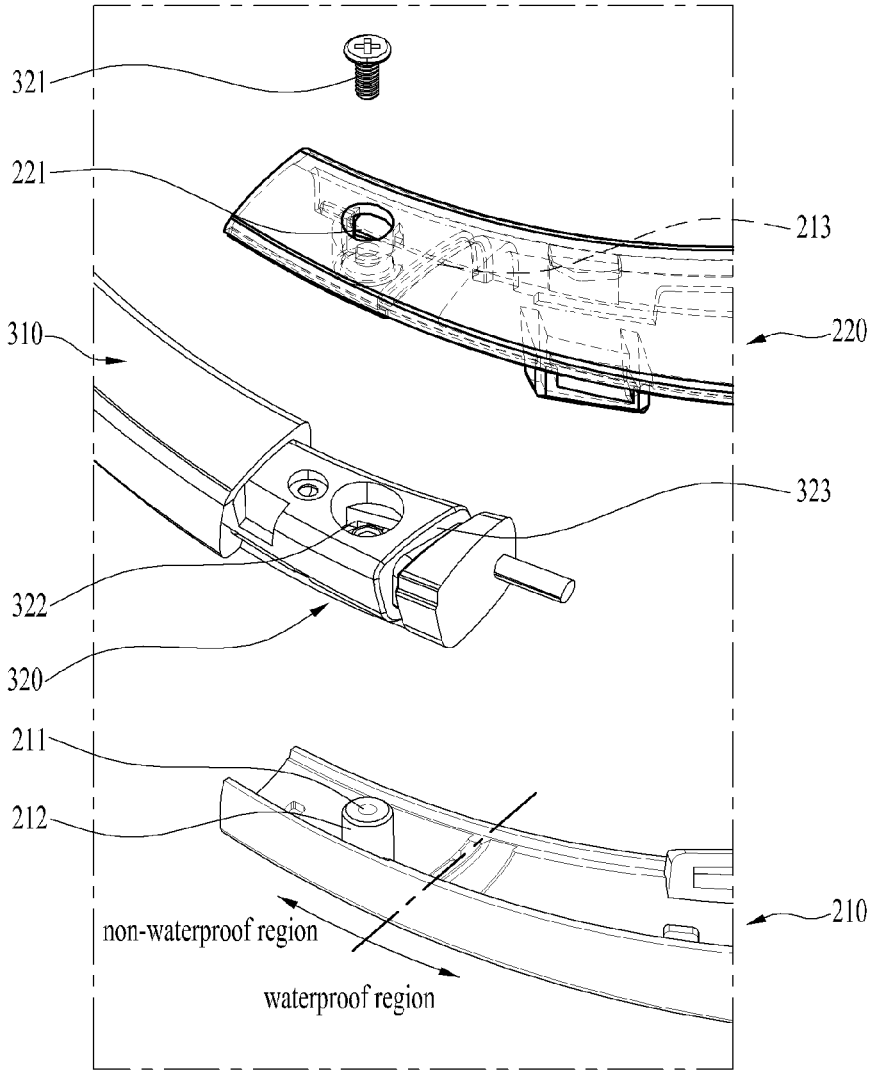
FIG. 10 is an exploded perspective diagram partially illustrating the portable sound equipment.

FIG. 10 is an exploded perspective diagram partially illustrating the portable sound equipment 100.

A coupling unit 320 may function as the fixing unit for fixing the neckband wire 310 to the main body 200. The coupling unit 320 may be provided in one end of the neckband wire 310 and a process for disposing the coupling unit 320 in the neckband wire 310 will be described later.

The coupling unit 320 may be fixed in one end of the main body 200.

A projection 212 provided corresponding to a coupling hole 322 of the main body 200 may be fixedly inserted in a coupling hole 322 formed in the coupling unit 320.

The projection 212 projected from the upper or lower case 210 or 220 of the main body may be fixedly coupled to the other case, so as to prevent the releasing of the neckband wire 310 and the coupling unit 320.

The upper case 210 and the lower case 220 may be hooked or fastened to each other by a hook or screw. In case of the screw fastening, a fifth screw hole 211 formed in the upper case 210 and a fourth screw hole 221 provided in the lower case 220 are fastened by a second screw 321.

A waterproof rib 213 and a waterproof groove 323 may be coupled to each other, so as to form a waterproof structure in a preset region of the main body 200 where the first printed circuit board 240.

The waterproof rib 213 may be projected along an inner rim of one end of the main body 200.

The waterproof groove 323 is formed in the coupling unit 320 and the waterproof rib 213 may be coupled to the waterproof groove 323. The coupling between the waterproof rib 213 and the waterproof groove 323 may perform the waterproof function to prevent water from flowing into the main body 200 from outside and the stable arrangement to prevent the movement of the coupling unit 320 in the main body 200 simultaneously.

In contrast, the waterproof rib 213 may be provided in a rim of the coupling unit 320 and the waterproof groove 323 may be provided in a rim of the main body 200. However, the former case is preferred to minimize the thickness of the main body case and secure the strength of the main body at the same time.

Figure 11:
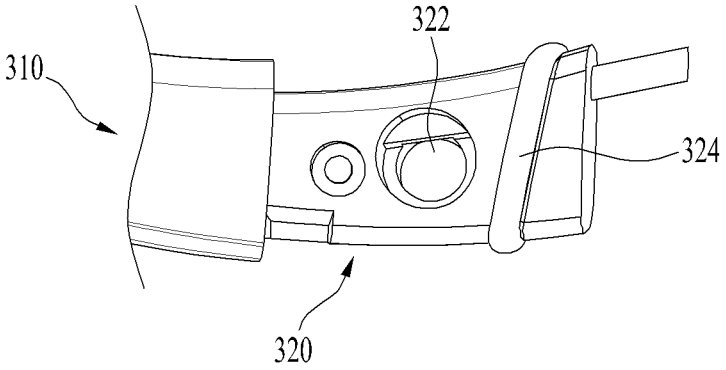
FIG. 11 is a diagram illustrating another example of a coupling unit in accordance with the present disclosure.

FIG. 11 is a diagram illustrating another example of the coupling unit 320 in accordance with the present disclosure.

Rather than the example of the coupling between the waterproof rib 213 and the waterproof groove 323 mentioned above, an O-ring 324 including an elastic material may be provided to realize the waterproof structure instead of both the waterproof rib 213 and the waterproof groove 323.

Referring to FIG. 10 again, the screw fastening or coupling structure between the coupling hole 322 of the coupling unit 320 and the projection 212 of the main body 200 might deteriorate the waterproof function. Accordingly, the coupling structure between the waterproof rib 213 and the waterproof groove 323 may be further inside toward the first printed circuit board 240, in other words, toward the first printed circuit board 240 than the coupling structure between the coupling hole 322 and the projection 212.

The region toward the first printed circuit board 240 with respect to the coupling region between the waterproof rib 213 and the waterproof groove 323, in other words, the inner region of the main body 200 may be a waterproof region. For easy explanation sake, the region toward the neckband wire 310 with respect to the coupling region between the waterproof rib 213 and the waterproof groove 323 may be defined as a non-waterproof region.

Figure 12:
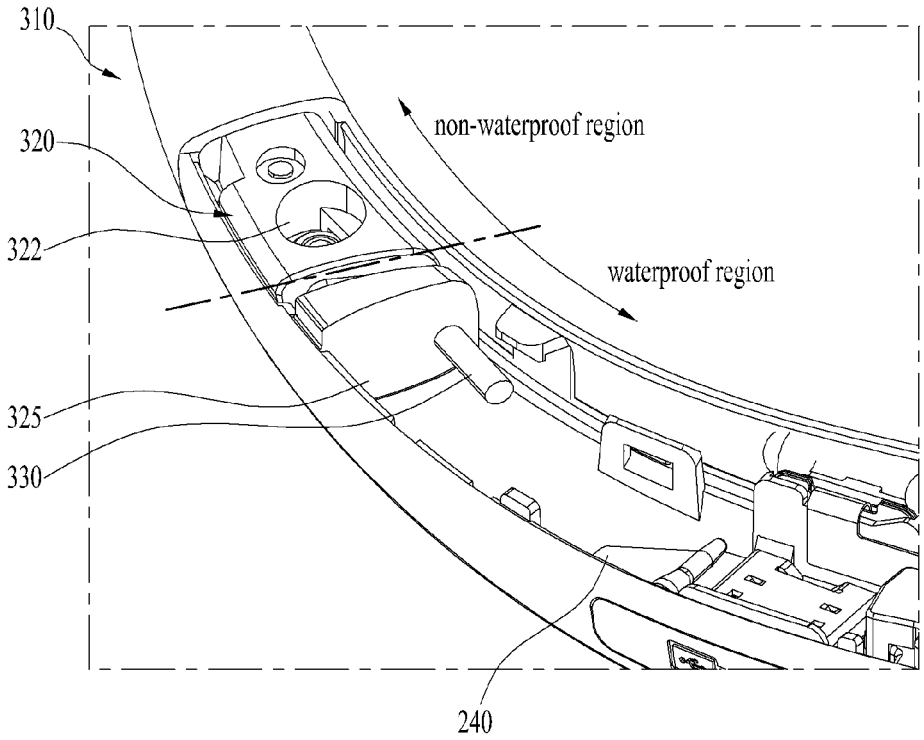
FIG. 12 is an exploded perspective diagram illustrating a region of the portable sound equipment.

FIG. 12 is an exploded perspective diagram illustrating a region of the portable sound equipment 100.

A first connection leading wire 330 may electrically connect both insides of the main body 200 with each other through an inner region of the neckband wire 310.

The first connecting leading wire 220 starts from the inside of the neckband wire 310 and penetrates the waterproof region of the coupling unit 320 to be electrically connected with the first printed circuit board 240. Especially, the first connection leading wire 330 may be projected from one end 325 of the coupling unit and closer to a predetermined portion of the coupling unit end 325, not to pass through the coupling hole 322.

Accordingly, the first connection leading wire 330 may prevent the deterioration of the coupling reliability between the waterproof rib 213 and the waterproof groove 323, when coming out via the waterproof region of the coupling unit 320 may be prevented.

In addition, the first connection leading wire 330 may prevent water from permeated there through, as directly inserted in the waterproof region of the main body 200 from the inner region of the neckband wire 310.

Figure 13:
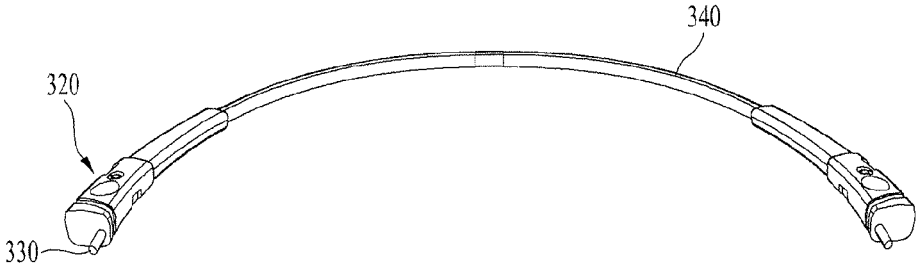
FIGS. 13 (*a*) through 13 (*c*) are diagrams time-serially illustrating a process for forming a neckband wire and a coupling unit in accordance with the present disclosure.
Figure 13:
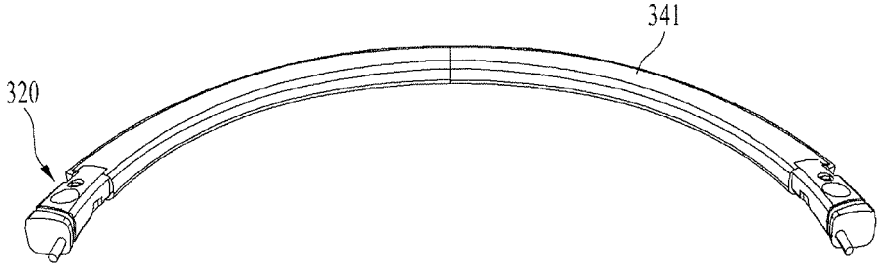
Figure 13:
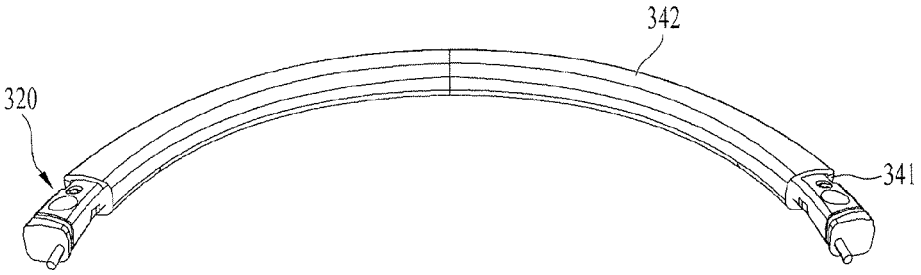

FIGS. 13 (*a*) through 13 (*c*) are diagrams time-serially illustrating a process for forming the neckband wire 310 and the coupling unit 320 in accordance with the present disclosure.

Referring to FIG. 13 (*a*), the first connection leading wire 330 is inserted inn a wire tube 340 to be protected. The wire tube 340 may be made of a non-conductive material.

A restore wire made of a material, e.g., a shape-memory alloy may be configured to restore the neckband wire 310, when the neckband wire 310 is deformed.

In case the applied force is released after the portable sound equipment 100 become widened to be worn on the user's neck, the portable sound equipment 100 may be restored into its original shape.

The restore wire may be also inserted in the wire tube 340. The coupling unit 320 may be double-injection-molded in the wire tube 340 in which both the restore wire and the first connection wire 330 are inserted.

Referring to FIG. 13 (*b*), a first wire portion 341 is double-injection-molded to cover the tire tube 340 and the entire or some region of the coupling unit 320 in a state of FIG. 13 (*a*).

The first wire portion 341 is configured to enhance the overall durability of the neckband wire 310 and stabilize the connection between the coupling unit 320 and the wire tube 340.

The first wire may include a predetermined material such as TPU (Thermoplastic Poly Urethane) or an elastic material such as rubber so as to perform the function.

Referring to FIG. 13 (*c*), a second wire portion 342 may be double-injection-molded in a state of FIG. 13 (*b*) and coupled to the first wire portion 341.

The first wire portion 341 may be provided in a region which is configured to directly contacts with the user's neck. Compared with the first wire portion 341, the second wire portion 342 may include a material with a higher frictional force. If necessary, a pattern may be engraved or embossed on a predetermined region of the second wire portion 342. The pattern may be formed when the second wire portion 342 is double-injection-molded in the first wire portion 341.

The second wire portion 342 may include a similar material to the first wire portion 341 such as TPU or rubber. Alternatively, the second wire portion 342 may include a material with a high frictional force such as silicon.

In case the first wire portion 341 and the second wire portion 342 are formed in separated processes, the regions may be realized in different colors. The realization of the two tone color results in an effect of a design improvement. In case the second wire portion 342 is provided further inside in the first wire portion 341 symmetrically, one sided, the user is able to recognize the upward and downward direction with respect to the entire portable sound equipment 100 easily.

Figure 14:
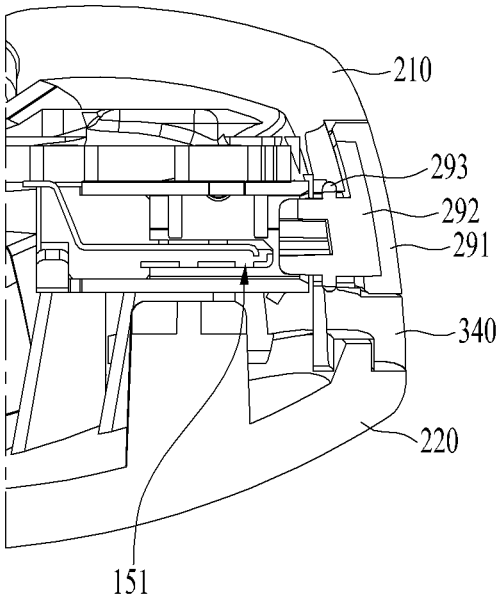
FIG. 14 is a sectional diagram of FIG. 7 along B-B'.

FIG. 14 is a sectional diagram of FIG. 7 along B-B'.

The main body 200 may include an input/output port 151 (the I/O port) as one example of the interface unit. More specifically, the I/O port 151 may be an USB (Universal Serial Bus) port or a USB-C type port.

Such the I/O port 151 has to be selectively connected with an external device, so that a waterproof cap 291 may be coupled to the I/O output 151 to realize waterproof.

The waterproof cap 291 may be configured to expose the I/O port 151 to an outer surface of the main body 200. A second sealing member is provided in an inner surface of the waterproof cap 291. The second sealing member 292 may make the I/O port 151 be waterproof initially and then a waterproof band 293 provided along an outer circumferential surface of the second sealing member 292 be waterproof secondarily.

Figure 15:
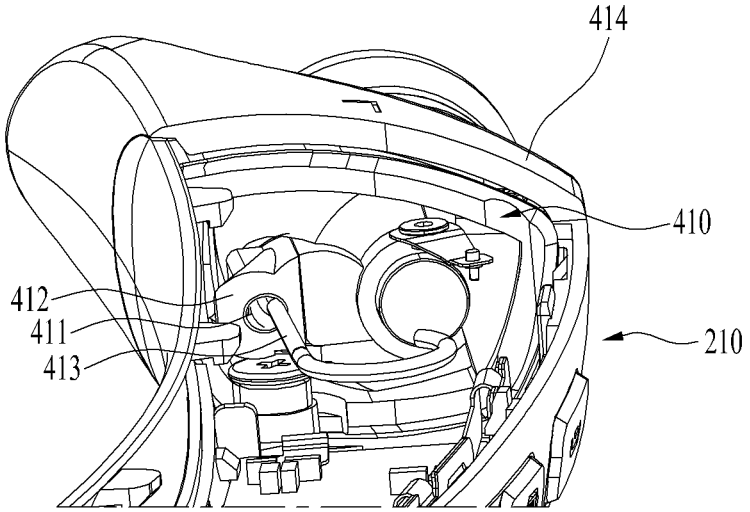
FIG. 15 is an exploded perspective diagram illustrating one end and the other end of a main body in accordance with the present disclosure.

FIG. 15 is an exploded perspective diagram illustrating one end and the other end of a main body 200 in accordance with the present disclosure.

The earbud may be electrically connected with an internal printed circuit board via a second connection leading wire 413 penetrating the collect hole 411 provided in the holder 410 formed in the other end of the main body 200.

The collect hole 411 may serve as a passage from the outside of the portable sound equipment 100 to the inside of the main body 200, so that it might be a problem in realizing the waterproof structure.

The collect hole 411 may be then formed with a diameter of a specific value or less. In this instance, there is room for blocking the collect hole 411 when fabricating the holder 410.

Accordingly, an auxiliary hole member 412 may be provided in the holder 410 to form the collect hole 411 with the preset diameter or less. The hole member 412 may include the collect hole 411 having a diameter of a specific value or less and then coupled to the holder 410.

The hole member 412 and the holder 410 may be coupled to each other by a bolding material, so as to realize a boundary waterproof structure.

The hole member 412 may be made of a material having a predetermined elasticity such as TPU or silicon.

Figure 16:
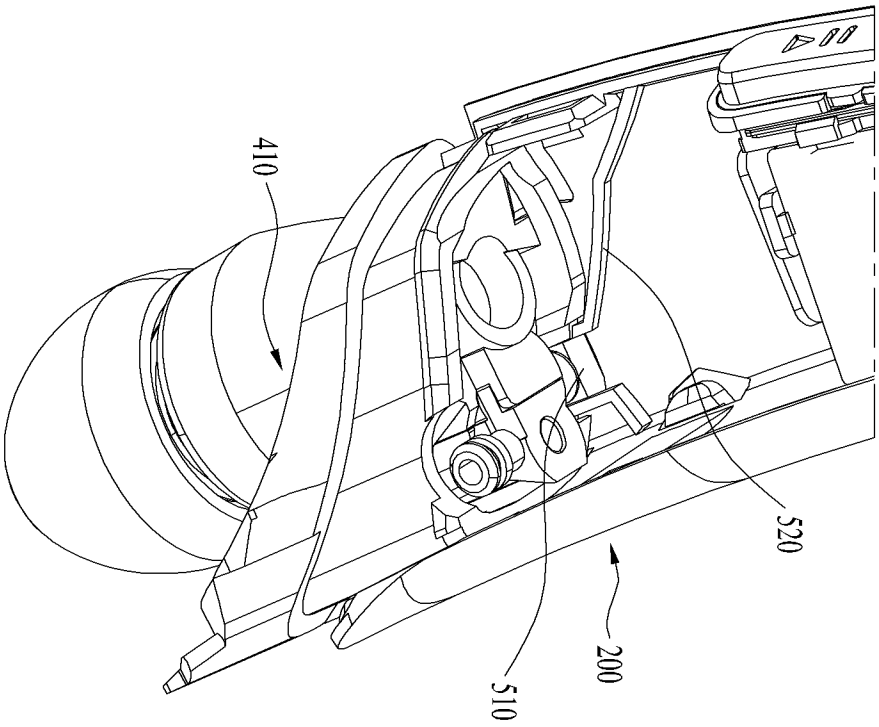
FIG. 16 is a diagram illustrating an inside and an outside with respect to the other end of the main body provided in the portable sound equipment.
Figure 17:
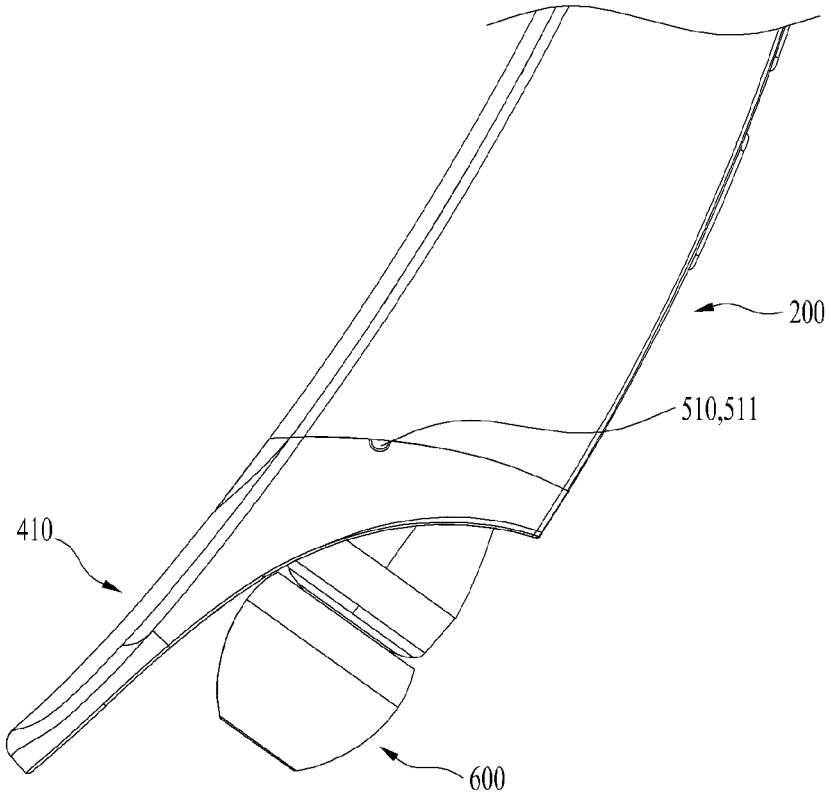
FIG. 17 is a diagram illustrating an inside and an outside with respect to the other end of the main body provided in the portable sound equipment.

FIG. 16 is a diagram illustrating an inside and an outside with respect to the other end of the main body provided in the portable sound equipment 100. FIG. 17 is a diagram illustrating an inside and an outside with respect to the other end of the main body 200 provided in the portable sound equipment 100.

In case water is drawn into the main body 200 despite the waterproof structure, it is required to deal with the water. The structure may be proposed to exhaust the water from the body 200 outside again, without touching the electronic components.

The portable sound equipment may have a waterway toward the front end on the premise that the front end is inclined in a state there the user is wearing the portable sound equipment. A guide unit may serve as the waterway toward the front end.

A drainage hole may be provided in the front end of the main body 200. The drainage hole may be formed in a boundary between the main body 200 and the holder 410.

The drainage hole provided in the front end of the main body 200 will not be visible easily even when the user is wearing the portable sound equipment 100 so as to expect the design improvement.

Especially, the guide unit may be formed as a nozzle type which becomes narrower as getting closer to the drainage hole.

A waterproof mesh may be provided in the drainage hole. The waterproof mesh may minimize the possibility of liquid flow into the main body via the drainage hole and facilitate the exhaustion of the liquid from the main body via the drainage hole simultaneously.

Although embodiments have been described with reference to a number of illustrative embodiments thereof, it should be understood that numerous other modifications and embodiments can be devised by those skilled in the art that will fall within the spirit and scope of the principles of this disclosure.

More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A portable sound equipment comprising:

a neckband wire configured to wrap a predetermined region of a user's neck;

a main body coupled to one end of the neckband wire;

a first printed circuit board disposed on an upper or lower surface of the main body;

a flat bracket disposed on the first printed circuit board and having one surface which contacts with the first printed circuit board;

a lateral bracket coupled to a lateral surface of the flat bracket;

a second printed circuit board supported to the lateral bracket and toward a lateral surface of the main body; and a side button disposed on the second printed circuit board and exposed outside the lateral surface of the main body.

2. The portable sound equipment of claim 1, further comprising:

a first sealing member configured to cover an inner surface of the side button and contact with the lateral surface of the main body by being compressed by the lateral bracket.

3. The portable sound equipment of claim 1, further comprising:

a battery disposed on the other surface of the flat bracket, wherein the flat bracket spaces the battery a preset distance apart from the first printed circuit board.

4. The portable sound equipment of claim 3, wherein an opening is formed in a preset region of the flat bracket.

5. The portable sound equipment of claim 1, further comprising:

a fastening screw hole formed in each of the flat bracket, the first printed circuit board and the surface of the main body where the first printed circuit board is disposed; and a first screw configured to fasten the flat bracket, the first printed circuit board and the main body to each other, after penetrating the fastening screw hole.

6. The portable sound equipment of claim 1, further comprising:

a coupling unit provided in one end of the neckband wire and secured to an inside of the end of the main body;

a waterproof rib projected along an inner circumference of the end of the main body; and a waterproof groove provided in the coupling unit and configured to be fastened to the waterproof rib.

7. The portable sound equipment of claim 6, further comprising:

a coupling hole formed in the coupling unit; and a projection projected from one region of the main body, corresponding to the coupling hole, wherein the fastening structure between the waterproof rib and the waterproof groove is further inside toward the first printed circuit board than the coupling structure between the coupling hole and the projection.

8. The portable sound equipment of claim 6, further comprising:

a first connection leading wire projected from one end of a waterproof region formed in the coupling unit and configured to be coupled to the first printed circuit board, wherein a non-waterproof region toward the neckband wire and a waterproof region toward the first printed circuit board are distinguished from each other with respect to a boundary of the coupling region between the waterproof rib and the waterproof groove.

9. The portable sound equipment of claim 1, further comprising:

a first connection wire coupled to the first printed circuit board after penetrating the neckband wire;

a wire tube in which the first connection leading wire is mounted; and a coupling unit coupled to one end of the wire tube and fixed in one end of the main body, wherein the neckband wire comprises, a first wire portion covering and coupled to the wire tube and a region of the coupling unit; and a second wire portion coupled to a region which contacts with the user's neck.

10. The portable sound equipment of claim 9, wherein the coupling unit is double-injection molded in the wire tube and one region of the coupling, and the second wire portion is double-injection-molded in the first wire portion.

11. The portable sound equipment of claim 9, wherein the first wire portion comprises TPU (thermoplastic Poly Urethane); and a pattern engraved or embossed on one region of the second wire.

12. The portable sound equipment of claim 1, further comprising:

an I/O port provided in the main body;

a waterproof cap configured to selectively expose the I/O port to an outer surface of the main body;

a second sealing member coupled to an inner surface of the waterproof cap; and a waterproof band provided along an outer surface of the second sealing member.

* * * * *